United States Patent [19]

Fujita et al.

[11] Patent Number: 4,640,890

[45] Date of Patent: Feb. 3, 1987

[54] COLOR PHOTOGRAPHIC MATERIAL WITH LIGHT INSENSITIVE SILVER CHLORIDE

[75] Inventors: Munehisa Fujita; Akio Mitsui, both of Kanagawa, Japan

[73] Assignee: Fuji Photo Film Co., Ltd., Kanagawa, Japan

[21] Appl. No.: 760,851

[22] Filed: Jul. 31, 1985

[30] Foreign Application Priority Data

Jul. 31, 1984 [JP] Japan ..... 59-161238

[51] Int. Cl.[4] ..... G03C 1/46; G03C 1/40; G03C 7/32

[52] U.S. Cl. ..... 430/504; 430/403; 430/505; 430/506; 430/509; 430/567; 430/961

[58] Field of Search ..... 430/504, 505, 506, 509, 430/567, 403, 961

[56] References Cited

U.S. PATENT DOCUMENTS

| | | | |
|---|---|---|---|
| 3,050,391 | 8/1982 | Thompson et al. | 430/567 |
| 3,140,179 | 7/1964 | Russell | 430/506 |
| 3,531,289 | 9/1970 | Wood | 430/603 |
| 3,574,628 | 4/1971 | Jones | 430/567 |
| 4,539,289 | 9/1985 | Saito et al. | 430/506 |
| 4,542,091 | 9/1985 | Sasaki et al. | 430/506 |
| 4,547,458 | 10/1985 | Iijima et al. | 430/506 |

*Primary Examiner*—Richard L. Schilling

*Attorney, Agent, or Firm*—Sughrue, Mion, Zinn, Macpeak & Seas

[57] ABSTRACT

A silver halide color photographic material is described comprising a support having thereon at least one red-sensitive silver halide emulsion layer, at least one green-sensitive silver halide emulsion layer, and at least one blue-sensitive silver halide emulsion layer, with at least one of said light-sensitive silver halide emulsion layers containing a mono-dispersed silver halide emulsion, said color photogrphic material further comprising at least one auxiliary layer containing silver halide grains having substantially light-insensitivity and containing more than 75 mole % silver chloride.

The silver halide color photographic material is improved in dependence of photographic characteristics with respect to the extent of stirring of a processing solution during development processing.

13 Claims, No Drawings

COLOR PHOTOGRAPHIC MATERIAL WITH LIGHT INSENSITIVE SILVER CHLORIDE

FIELD OF THE INVENTION

This invention relates to a silver halide color photographic material showing improved development processing stability, and, in particular, to a silver halide color photographic material having been improved in dependence with respect to the extent of stirring of a processing solution during development processing.

BACKGROUND OF THE INVENTION

Silver halide color photographic materials are generally classified into color negative photographic materials and color reversal photographic materials. "Color negative photographic materials" refers to color photographic materials capable of forming negative images by applying thereto color negative processing after imagewise exposure, and "color reversal photographic materials" refers to color photographic material capable of forming positive images by applying thereto color reversal processing after imagewise exposure. Both the color negative photographic material and the color reversal photographic material have fundamental similar structures. That is, both of these color photographic materials are composed of a support having coated thereon combinations of at least three kinds of silver halide emulsions each having different color sensitivity (the color sensitivity is a property of being sensitive to one of three visible spectral regions, i.e., red, green, or blue), and three couplers, for forming cyan, magenta, and yellow dyes, respectively.

For forming images having proper color reproduction in a silver halide color photographic system, colored dyes having appropriate spectral sensitivity distributions and spectral absorption characteristics are applied for the silver halide color photographic material, and are particularly required to keep a proper balance in the gradation characteristics of plural color images and a proper balance in sensitivity.

It is preferred that the quality of images obtained using a color photographic material is determined by photographing various photographic subjects, but a method of evaluating the quality of color images by the form of a characteristic curve of each color photographic material, showing the image density as a function of an exposure amount, is usually employed as a practical and objective test in the field of the art. For example, it is described in Eiji Hozumi, *Practice of Sensitometry,* 1st edition, page 156, that gradation characteristic balance and sensitivity balance of a color image have a strong influence on the color reproducing characteristics and tone reproducing characteristics of the image of the color photographic material.

That is, with respect to the gradation characteristic balance between different color images, in general, there exist portions from a highlight portion having comparatively low density to a shadow portion having a comparatively high density in colors reproduced in a picture, and in a silver halide color photographic material having improper gradation characteristic balance, even when a proper color reproduction is obtained, for example, in a highlight portion, undesirable color reproduction is obtained in an intermediate portion or a shadow portion, or even when a proper color reproduction is obtained in an intermediate portion, undesirable color reproduction is obtained in a shadow portion or a highlight portion. Also, with respect to the sensitivity balance between different color images, it is important that the sensitivities of the color images are matched with a sensitivity set to obtain the optimum image. If even one of the color images is outside the optimum sensitivity condition, the color balance of the color images obtained differs from that of the real photographic subject, and hence unsatisfactory results are obtained.

As described above, the gradation characteristic balance and the sensitivity balance of different color images are very important characteristics in a color photographic material.

Now, color photographic materials are usually continuously processed by means of an automatic developing machine in a photographic laboratory, but since each photographic laboratory employs each processing condition for each automatic processor in the laboratory, it sometimes happens that even in the case of using the same kind of color photographic materials, a desired photographic performance (in particular, a desired gradation characteristic balance and a desired sensitivity balance among the above-described different color images) cannot be obtained by a photographic laboratory. This problems becomes serious in the case of performing high-temperature quick development processing for the purpose of reducing the costs and labor required for the photographic process.

As the result of extensive investigations on the cause of this problem, the present inventors have found that the difference in the extent of stirring for the developer of a color development in the case of a color negative development process or of a first development (black-and-white development) in the case of a color reversal development process causes a difference in the photographic performance according to the differences in the sort of an automatic processor employed in each photographic laboratory. The difference in the extent of stirring for a developer as noted above occurs in an ordinary photographic process according to the size of a developer tank, the nitrogen gas bubbling time and the place of forming nitrogen bubbles in the case of performing the stirring by bubbling of nitrogen gas, the number of photographic materials immersed in the developer, the difference in the type of the processor, e.g., a hanger type, a roll type, a roller transport type, etc., and the transporting speed of a photographic film to be processed.

It has further been found that when a so-called mono-dispersed silver halide emulsion is used for a silver halide photographic emulsion, the image quality is liable to be deteriorated by deviations in the stirring conditions, as described above, for the developer.

A mono-dispersed silver halide emulsion means a silver halide emulsion wherein more than 95% of the total silver halide grains, in grain number of weight, have grain sizes within ±40% of the mean grain size, and, because of the photographic characteristics of relatively high contrast, if the mono-dispersed silver halide emulsion is used for a low-sensitive silver halide emulsion layer which is selected from two or more split light-sensitive silver halide emulsion layers each having the same color sensitivity but having different sensitivity, the reproducibility of the highlight portion (e.g., the highlight portion of the printed image on a color photographic paper in the case of a color negative photographic material, or the highlight portion of images formed in a color reversal photographic material) of images is excellent as compared to the case of using a poly-dispersed silver halide photographic emulsion.

The reason why the influence of the deviation of the stirring condition for a developer becomes large in the case of using a mono-dispersed silver halide emulsion has not yet been fully clarified, but it is thought that since a mono-dispersed silver halide emulsion has high contrast gradation characteristics, as described above, when the sensitivity is fluctuate by the change of the stirring condition at development, the changing extent of the image density occurring with the dispersion is liable to become large and the change in visual tint of images is liable to become conspicuous.

SUMMARY OF THE INVENTION

The present invention has been made to solve that problems of the above-described circumstances, and an object of this invention is to provide a silver halide color photographic material showing reduced change in photographic performance due to deviation in the extent of stirring for developer at development process of the photographic material.

A more specific object of this invention is to provide a silver halide color photographic material capable of providing good color reproducibility which is almost the same as in the case of developing under a normal sufficient stirring of developer even under a substantially non-stirred state of developer during the development process, without being accompanied by a reduction in photographic sensitivity, a change of gradation, and the deterioration of tint.

As a result of extensive investigations, it has now been discovered that the above-described objects of this invention can be attained by forming at least one auxiliary layer containing silver halide grains containing at least 75 mole% silver chloride and having substantially light-insensitivity in a silver halide color photographic material comprising a support having thereon at least one red-sensitive silver halide emulsion layer, at least one green-sensitive silver halide emulsion layer, at least one blue-sensitive silver halide emulsion layer, with at least one of said light-sensitive silver halide emulsion layers containing a mono-dispersed silver halide emulsion.

DESCRIPTION OF PREFERRED EMBODIMENTS

The invention is described below in more detail.

The mono-dispersed silver halide emulsion for use in this invention means a silver halide emulsion wherein more than 95% of the total silver halide grains present in the specific mono-dispersed silver halide emulsion layer, in grain number or weight, have grain sizes within ±40% of the mean grains size. The mono-dispersed silver halide emulsion for use in this invention has a coefficient of variation (S/F), as statistically defined as a ratio of standard deviation (S) to mean grain size (F), of about 0.20. The mono-dispersed silver halide emulsion for use in this invention preferably has a coefficient of variation of 0.15 or less. The silver halide grains of the mono-dispersed silver halide emulsion for use in this invention may be a regular crystal form such as cubic, octahedral, tetradecahedral, rhombic dodecahedral, etc., or a mixture of these crystal forms.

The mono-dispersed silver halide emulsion for use in this invention and a poly-dispersed silver halide emulsion capable of being used together therewith are preferably silver iodobromide emulsion wherein the silver iodobromide grains preferably contain 20 mole% or less silver iodide, particularly preferably 7 mole% or less silver iodide.

The mono-dispersed silver halide emulsion for use in this invention is preferably used in the emulsion layer having lower sensitivity of a photographic material comprising two or more emulsion layers each having the same color sensitivity but having different sensitivity.

The light-sensitive silver halide for use in this invention is preferably a negative type silver halide, and is particularly preferably used for a color reversal photographic material. The process for forming color reversal image comprises a black-and-white development (first development) and a fogging color development in this order.

It is necessary that the silver halide grains for use in this invention having substantially light-insensitivity contain at least 75 mole% silver chloride. Silver halide grains of any composition can be used in this invention provided that the silver halide grains contain silver chloride in an amount of at least 75 mole%, but silver chloride, or silver chlorobromide or silver chloroiodobromide each containing at least 75 mole% silver chloride is preferred. A more preferred result is obtained in the case of silver chloride or silver chlorobromide containing at least 75 mole% silver chloride. It is even more preferred that the content of silver chloride is at least 90 mole %, and hence silver chlorobromide containing more than 90 mole% silver chloride is especially preferred and silver chloride is most particularly preferred. On the other hand, the grain size of the silver halide grains is preferably from 0.05 to 1 micron, and more preferably from 0.1 to 0.5 micron in mean grain size. The mean grain size is determined herein with a grain diameter in those particles which are spherical or nearly spherical, and an edge length in those particles which are cubic as a grain size, and is expressed as a mean value calculated from projected areas.

Also, there is not particular restriction about the grain form of the silver halide grains, and the silver halide grains may be regular or irregular grains.

Also, the dispersibility of grain may be poly-dispersibility or mono-dispersibility.

The silver halide grains as described above are defined as "silver halide grains having substantially light-insensitivity". In this invention, the terminology "having substantially light-insensitivity" means that the silver halide grains are not light-sensitive in a relative relation with the silver halide emulsion layer having the lowest sensitivity constituting the red-, green-, and blue-sensitive silver halide emulsion layers. More particularly, it is to be understood that when light necessary for sensitizing the light-sensitive silver halide for constituting the light-sensitive silver halide emulsion layer having the lowest light sensitivity is applied to the photographic material of this invention, the silver halide grains "having substantially light-insensitivity" are not "substantially exposed" by the light energy. More practically, it is preferred that the silver halide grains of this invention having substantially light-insensitivity are silver halide particles having a light sensitivity of at most 1/10 of that of the light-sensitive silver halide grains having the lowest light sensitivity described above.

Furthermore, it is preferred that the "silver halide grains having substantially light-insensitivity" are prepared in the presence of a water-soluble rhodium in an optional step before finishing the first ripening (physical ripening) in the production step of the silver halide emulsion containing the silver halide grains. Such silver halide grains have a function of effectively reducing the change in photographic performance due to deviations in stirring conditions of the developer.

Silver halide emulsions containing a rhodium salt are described, for example, in British Pat. No. 775,197; U.S. Pat. No. 3,531,289; Japanese Patent Application (OPI) Nos. 125734/81, 149030/81, 149031/81; etc. However, the emulsions disclosed therein are not used for the purpose as described in this invention, that is, the emulsion is used solely as a super low-speed silver halide emulsion for photographic light-sensitive materials for being used at bright room. No combined use of the emulsion and other higher-speed light-sensitive silver halide emulsions than that of the emulsion is disclosed therein.

The water-soluble rhodium salt for use in this invention includes rhodium chloride, rhodium trichloride, rhodium ammonium chloride, etc., and rhodium complex salts can also be used.

The rhodium salt for use in this invention may be added to a silver halide emulsion in any step before finishing the first ripening during the preparation of the silver halide emulsion, but it is preferred that the rhodium salt is added thereto during the formation of the silver halide grains, and the addition amount of the rhodium salt generally is higher than $1\times10^{-6}$ mole, preferably is higher than $1\times10^{-5}$, and more preferably is within a range of from $5\times10^{-5}$ to $1\times10^{-3}$ mole per mole of silver.

"The silver halide grains having substantially light-insensitivity" for use in this invention may have fogging nuclei in the grains, but it is preferred that the silver halide grains do not have fogging nuclei.

In this invention, "the silver halide grains having substantially light-insensitivity" can adsorb a sensitizing dye on the surfaces thereof or various compounds can be adsorbed on the surface thereof for stabilizing the performance. Examples of the sensitizing dye which can be used for this purposes are described, for example, in German Patent No. 929,080; U.S. Pat. Nos. 2,493,748, 2,503,776, 2,519,001, 2,912,329, 3,656,959, 3,672,897, 3,694,217, 4,025,349, 4,046,572; British Pat. No. 1,242,588; Japanese Patent Publication Nos. 14030/69, 24844/77; etc.

These sensitizing dyes may be used individually or as a combination thereof. Also, for stabilizing the photographic performance, various compounds known as stabilizers, for example, azoles such as benzothiazolium salts, nitroindazoles, triazoles, benzotriazoles, benzimidazoles (in particular, those with nitro- or halogen-substituents), etc.; heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole, etc.), mercaptopyrimidines, etc.; the foregoing heterocyclic mercapto compounds having a water solubilizing group such as a carboxy group and a sulfon group; thioketo compounds such as oxazolinthione; azaindenes such as tetraazaindenes (in particular, 4-hydroxy-substituted (1,3,3a,7)-tetraazaindenes); benzenethiosulfonates; benzenesulfinic acids; etc.

"The silver halide grains having substantially light-insensitivity" for use in this invention are used in an auxiliary layer separately from light-sensitive emulsion layers containing light-sensitive silver halide grains.

The auxiliary layer may be formed at any position among the photographic layers constituting a color photographic material of this invention, but it is preferred that the auxiliary layer is formed on the outside of the light-sensitive silver halide emulsion layer disposed outermost side of the red-sensitive, green-sensitive, and blue-sensitive silver halide emulsion layers with respect to the support.

There is no particular restriction about the coating amount of the above-described auxiliary layer in this invention but it is ordinarily preferred that the coating amount of "the silver halide grains having substantially light-insensitivity" is in a range of from $1\times10^{-6}$ mole/m$^2$ to $1\times10^{-2}$ mole/m$^2$. Also, it is preferred that the coating amount of silver (in the form of silver halide) in the auxiliary layer is from 0.2% by weight to 20% by weight, and particularly preferably from 0.7% by weight to 7% by weight, based on the total weight of light-sensitive silver halide in the photographic material.

The light-sensitive silver halide emulsions for use in this invention are now explained in more detail. As the silver halide for these silver halide emulsions, silver chloride, silver bromide, silver chlorobromide, silver iodobromide, silver chloroiodobromide, etc., can be used, but silver iodobromide containing less than 10 mole% silver iodide is preferred.

Also, there are no particular restrictions on the grain size of the light-sensitive silver halides for use in this invention, but the grain size is preferably less than 3 microns, and preferably less than 2 microns.

The grains of the silver halide may be a regular crystal form such as cubic, octahedral, tetradecahedral, rhombic dodecahedral, etc., or a mixture of these crystal forms. Also, a tabular silver halide emulsion wherein projected areas of silver halide grains having a diameter larger than 5 times the thickness thereof are 50% or more based on the total projected areas of grains (as described in Japanese Patent Application (OPI) Nos. 127921/83, 113927/83, etc.) can be used in this invention. The silver halide grains may have a uniform crystal structure throughout the grains or may have a layer structure having different property between the inside and outside thereof, or may be a so-called conversion type silver halide emulsion as described in British Pat. No. 635,841, U.S. Pat. No. 3,622,318, etc.

These silver halide photographic emulsions can be prepared by the methods described in Mees, *The Theory of the Photographic Process,* 4th edition, published by MacMillan Co. (1976); P. Glafkides, *Chimie et Photographique,* published by Paul Montel (1957); G. F. Duffin, *Photographic Emulsion Chemistry,* published by The Focal Press (1966); and V. L. Zelikman et al, *Making and Coating Photographic Emulsions,* published by The Focal Press (1964). That is, the photographic emulsions can be prepared by an acid method, a neutralization method, an ammonia method, etc., and as the mode of reacting a soluble silver salt and a solution halide, a single-jet method, a double-jet method, or a combination of these methods may be used.

For preparing silver halide emulsions, a so-called reverse mixing method for forming silver halide grains under the presence of excessive silver ion can be used. As one mode of a double-jet method, a so-called controlled double-jet method for maintaining substantially constant pAg in a liquid phase wherein silver halide is formed can be also used.

Silver halide grains may be formed or physically ripened in the presence of a cadmium salt, a zinc salt, a lead salt, a thallium salt, an iridium salt or a complex salt thereof, a rhodium salt or a complex salt thereof, an iron salt of a complex salt thereof, etc.

The grain size distribution of the light-sensitive silver halide emulsion may be narrow or broad, but at least one of light-sensitive silver halide emulsion layers is composed of a silver halide emulsion containing mono-dispersed silver halide. The emulsion layer containing a mono-dispersed silver halide emulsion layer may be a red-sensitive emulsion layer, a green-sensitive emulsion layer, or a blue-sensitive emulsion layer. When each color-sensitive emulsion layer is composed of two or more emulsion layers each having the same color sensitivity but having different sensitivity, it is preferred that the emulsion layer having a lower sensitivity is composed of the mono-dispersed silver halide emulsion layer. In this case, the emulsion layer having a higher sensitivity may be composed of a mono-dispersed silver halide emulsion or a poly-dispersed silver halide emulsion.

In the case of preparing such a mono-dispersed silver halide emulsion, it is preferred to use a silver halide solvent in steps before finishing physical ripening. Examples of the silver halide solvent are preferably ammonia, potassium thiocyanate, ammonium thiocyanate, thioether compounds (described in, for example, U.S. Pat. Nos. 3,271,157, 3,574,628, 3,704,130, 4,297,439, 4,276,374, etc.), thion compounds (described, e.g., in Japanese Patent Application (OPI) Nos. 144319/78, 82408/78, 77737/80, etc.), amine compounds (described, e.g., in Japanese Patent Application (OPI) No. 100717/79, etc.), etc.

Examples of the particularly preferred silver halide solvents for mono-dispersing silver halide emulsion are tetra-substituted thioureas and organic thio ethers.

A preferred tetra-substituted thiourea silver halide solvent for use in this invention is represented by the following formula (I):

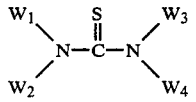

(I)

wherein $W_1$, $W_2$, $W_3$ and $W_4$ (which may be the same or different) each represents a substituted or unsubstituted alkyl group, an alkenyl group (such as allyl group, etc.), or a substituted or unsubstituted aryl group; the total carbon atom number of said $W_1$ to $W_4$ is preferably less than 30; or said $W_1$ and $W_2$, said $W_2$ and $W_3$, or said $W_3$ and $W_4$ may combine with each other to form a 5-membered or 6-membered heterocycline ring (imidazolinethion, piperidine, morpholine, etc.). The above-described alkyl group may be a straight-chain or branched-chain group.

Examples of the substituent for the alkyl group include a hydroxy group (—OH), a carboxy group, a sulfonic acid group, an amino group, an alkoxy group (O-alkyl group) the alkyl moiety of which has from 1 to 5 carbon atoms, a phenyl group or a 5-membered or 6-membered heterocyclic ring (e.g., furan, etc.). Examples of substituents for the aryl group above include a hydroxy group, a carboxy group, and a sulfonic acid group.

In this case, it is particularly preferred that at least three of said $W_1$ to $W_4$ are alkyl groups, each having from 1 to 5 carbon atoms, an aryl group such is a phenyl group, and the total number of carbon atom of said $W_1$ to $W_4$ is less than 20.

Specific examples of the compounds for use in this invention are shown below.

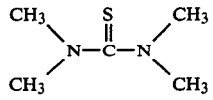

I-1

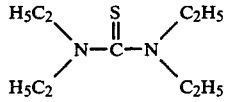

I-2

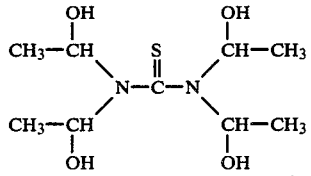

I-3

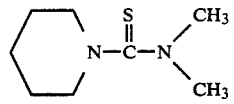

I-4

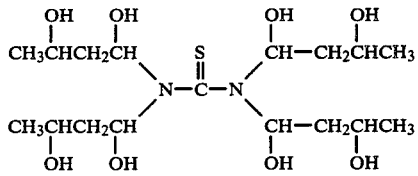

I-5

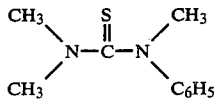

I-6

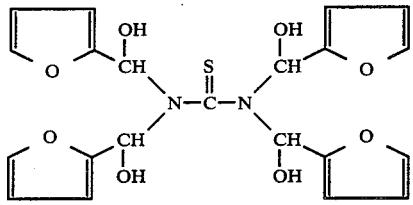

I-7

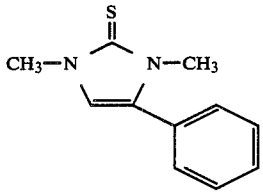

I-8

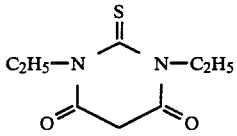

I-9

-continued

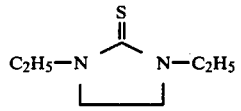

I-10

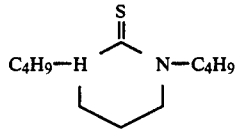

I-11

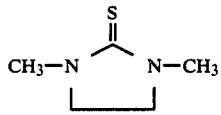

I-12

Preferred examples of the organic thioether compounds for use in this invention are the compounds represented by following formulae (II A) and (II B):

$$Q-[(CH_2)_r-CH_2-S-(CH_2)_2-X'-(R)_p-(CH_2)_2-(R')_q-S-CH_2-(CH_2)_m-Z']_n \quad \text{(II A)}$$

$$Q-(CH_2)_m-CH_2-S-(CH_2)_n-S-CH_2-(CH_2)_r-Z' \quad \text{(II B)}$$

wherein r and m each is 0 or an integer of 1 to 4, n is an integer of 1 to 4, p and q each is 0 or an integer of 1 to 3, X' is an oxygen atom, a sulfur atom, $$-\overset{O}{\overset{\|}{C}}NH-,\ -\overset{O}{\overset{\|}{C}}-,\ -\overset{O}{\overset{\|}{C}}-O-,$$

R and R' each is an ethylene oxide group, and Q and Z' each is —OR'', $$-\overset{O}{\overset{\|}{C}}-OR''$$

(wherein R'' is a hydrogen atom or an alkyl group having from 1 to 5 carbon atoms), $$-\overset{O}{\overset{\|}{C}}NH_2,$$

or Q and Z' represent the divalent group for X' and may combine with each other to form a heterocyclic ring.

Preferred examples of the compounds represented by formula (II A) or (II B) are the compounds represented by following formulae (II C) to (II H):

$$HO-R^3-(S-R^5)_r-S-R^3-OH \quad \text{(II C)}$$

$$(HO-R^3-S-R^3-O-R^5)_2 \quad \text{(II D)}$$

$$(R^4-O-R^3-S-R^3-\overset{O}{\overset{\|}{C}}-NH-R^5)_2 \quad \text{(II E)}$$

$$(R^4-O-R^3-S-R^3)_2S \quad \text{(II F)}$$

$$(R^4-NH-\overset{O}{\overset{\|}{C}}-R^3-S-R^3)_2O \quad \text{(II G)}$$

-continued

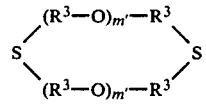

(II H)

wherein r' is 0 or an integer of 1 to 3, m' is an integer of 1 or 2, $R^3$ and $R^5$ each is alkylene group having from 1 to 5 carbon atoms, such as a methylene group and an ethylene group, $R^4$ is an alkyl group having from 1 to 5 carbon atoms, such as an ethyl group.

Specific examples of the organic thioether compounds that can be preferably used in this invention are as follows:

$$HO(CH_2)_2-S-(CH_2)_2-S-(CH_2)_2OH \quad \text{(II-1)}$$

$$HO(CH_2)_3-S-(CH_2)_2-S-(CH_2)_3OH \quad \text{(II-2)}$$

$$HO(CH_2)_2-S-(CH_2)_2-S-(CH_2)_2-S-(CH_2)_2OH \quad \text{(II-3)}$$

$$[HO-(CH_2)_2-S-(CH_2)_2O-CH_2]_2 \quad \text{(II-4)}$$

$$[HO-(CH_2)_2-S-(CH_2)_5O-(CH_2)_2]_2 \quad \text{(II-5)}$$

$$[H_5C_2-O-(CH_2)_2-S-(CH_2)_2]_2S \quad \text{(II-6)}$$

$$[H_3C-O-(CH_2)_4-S-(CH_2)_4]_2S \quad \text{(II-7)}$$

$$[H_3C-NH-\overset{O}{\overset{\|}{C}}-(CH_2)_2-S-(CH_2)_2]_2O \quad \text{II-8}$$

$$[H_5C_2-NH-\overset{O}{\overset{\|}{C}}-(CH_2)_3-S-(CH_2)_3]_2O \quad \text{II-9}$$

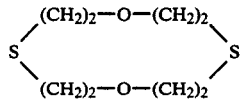

II-10

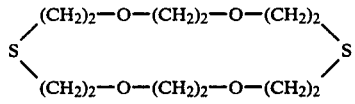

II-11

$$[NH_2CO(CH_2)_2-S-(CH_2)_2CONH-CH_2]_2 \quad \text{(II-12)}$$

$$HOOC-CH_2-S-(CH_2)_2-S-CH_2-COOH \quad \text{(II-13)}$$

$$HOCH_2\underset{\underset{OH}{|}}{C}HCH_2-S-CH_2CH_2-S-CH_2\underset{\underset{OH}{|}}{C}HCH_2OH \quad \text{II-14}$$

$$[H_3C-O(CH_2)_2-S-(CH_2)_2-\overset{O}{\overset{\|}{C}}-NH-CH_2]_2 \quad \text{II-15}$$

The amount of the silver halide solvent for use in this invention can be changed in a wide range according to the desired effect thereof, the properties of the compounds to be utilized, etc. In general, the silver halide solvent can be used in an amount of from about $5\times10^{-6}$ mole to about $5\times10^{-2}$ mole per mole of silver halide, with a particularly preferred range being from about $1\times10^{-5}$ to about $2.5\times10^{-2}$ mole per mole of silver halide.

The silver halide solvent for use in this invention is added to a silver halide emulsion in at least one step of the formation step of the precipitation of the silver halide grains and the subsequent step of physical ripening of the silver halide grains.

In the silver halide solvents described above, the tetra-substituted thioureas represented by formula (I) above are particularly preferred for purposes of this invention.

After the formation of precipitations or after physical ripening, soluble salts are usually removed from the silver halide emulsion and for the purpose, a noodle washing method, which is performed by gelling gelatin in the emulsion as well known for the means, or a flocculation method utilizing an inorganic salt composed of multivalent anion (e.g., sodium sulfate), an anionic surface active agent, an anionic polymer (e.g., polystyrenesulfonic acid), or a gelatin derivative (e.g., aliphatic acylated gelatin, aromatic acylated gelatin, aromatic carbamoylated gelatin, etc.) may be used. The process of removing soluble salts may be omitted as the case may be.

The silver halide emulsion for use in this invention may be used as a primitive emulsion without being chemically sensitized, but is usually chemically sensitized. For the chemical sensitization, methods that can be employed include those described in the above-described texts by Glafkides or by zelikman, and H. Frieser, editor, *Die Grundlagen der Photographischen Prozesse mit Silberhalogeniden,* Akademische Verlagsgesellshaft (1968).

Examples of chemical sensitization include a sulfur sensitization method using active gelatin or a sulfur-containing compound capable of reacting with silver (e.g., thiosulfates, thioureas, mercapto compounds, rhodanines, etc.), a reduction sensitizing method using a reducing substance (e.g., stannous salts, amines, hydrazine derivatives, formamidinesulfinic acid, silane compounds, etc.), and a noble metal sensitizing method using a noble metal compound (e.g., gold compounds and complex salts of metals belonging to group VIII of the periodic table, such as platinum, iridium, palladium, etc.). These can be used individually, or as a combination thereof.

The silver halide photographic emulsions for use in this invention may be spectrally sensitized by methine dyes and the like. Examples of such dyes include cyanine dyes, merocyanine dyes, complex cyanine dyes, complex merocyanine dyes, holopolar cyanine dyes, hemicyanine dyes, styryl dyes, and hemioxoonole dyes. Particularly useful dyes are cyanine dyes, merocyanine dyes and complex merocyanine dyes. For these dyes, nuclei which are usually utilized for cyanine dyes can be applied as basic heterocyclic nuclei.

Specific examples of useful sensitizing dyes are described, for example, in German Pat. No. 929,080; U.S. Pat. Nos. 2,231,658, 2,493,748, 2,503,776, 2,519,001, 2,912,329, 3,656,959, 3,672,897, 3,694,217, 4,025,349 and 4,046,572; British Pat. No. 1,242,588; and Japanese Patent Publication Nos. 14030/69, 24844/77.

These sensitizing dyes may be used individually or as a combination thereof. Combinations of sensitizing dyes are frequently used for the purpose of supersensitization. Specific examples such combinations of sensitizing dyes are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707; British Pat. Nos. 1,344,281 and 1,507,803; Japanese Patent Publication Nos. 4936/78 and 12375/78; and Japanese Patent Application (OPI) Nos. 110618/77 and 109925/77.

The silver halide emulsions for use in this invention may further contain, together with the sensitizing dyes, dyes having no spectral sensitizing function by themselves, or substances which do not substantially absorb visible light, but which nevertheless show supersensitizing effect. Examples of these substances include aminostyryl compounds substituted by a nitrogen-containing heterocyclic group (as described, for example, in U.S. Pat. Nos. 2,933,390 and 3,635,721), aromatic organic acid-formaldehyde condensation products (as described, for example, in U.S. Pat. No. 3,743,510), cadmium salts, azaindene compounds, etc. The combinations of substances described in U.S. Pat. Nos. 3,615,613, 3,615,641, 3,617,295, 3,635,721, etc., are particularly advantageous.

The invention can be applied to a multilayer multicolor photographic material having on a support at least two silver halide photographic emulsion layers each having different spectral sensitivity. A multilayer natural color photographic material of this invention is usually composed of a support having thereon at least one red-sensitive silver halide emulsion layer, at least one green-sensitive silver halide emulsion layer, and at least one blue-sensitive silver halide emulsion layer. The order of these emulsion layers may be selected according to the particular requirements. In the color photographic material of this invention, it is preferred that a silver halide emulsion layer is composed of two or more emulsion layers each having a same color sensitivity and having different sensitivity.

The photographic materials of this invention may further contain various compounds for preventing the formation of fog or stabilizing the photographic performance, during a preparation step and a shelf-life thereof. Examples of these compounds are azoles such as benzothiazolium salts, nitroimidazoles, nitrobenzimidazoles, chlorobenzimidazoles, bromobenzimidazoles, mercaptothiazoles, mercaptobenzothiazoles, mercaptothiadiazoles, aminotriazoles, benzotriazoles, nitrobenzotriazoles, mercaptotetrazoles (in particular, 1-phenyl-5-mercaptotetrazole, etc.), etc.; mercaptopyrimidines, mercaptotriazines, thioketo compounds (e.g., oxazolinthione); azaindenes such as triazaindenes, tetraazaindenes (in particular, 4-hydroxy-substituted (1,3,3a,7)-tetraazaindenes), pentaazaindenes, etc.; benzenethiosulfonic acid, benzenesulfinic acid, benzenesulfonic acid amide, etc.

Specific examples of a method of using them are described, for example, in U.S. Pat. Nos. 3,954,474 and 3,982,947; and Japanese Patent Publication No. 28660/77.

The color photographic materials of this invention may further contain various surface active agents for purposes of coating aid, antistatic prevention, sliding improvement, improvement of dispersibility, prevention of sticking, and improvement of photographic properties (e.g., development acceleration, high contrast, sensitization, etc.) in the silver halide photographic emulsion layers or other hydrophilic colloid layers.

The color photographic materials of this invention may further contain, in the silver halide photographic emulsion layers, polyalkylene oxide, or the derivatives thereof such as the ethers, esters, amines, etc., thereof, thioether compounds, thiomorpholines, quaternary ammonium salt compounds, urethane derivatives, urea derivatives, imidazole derivatives, 3-pyrazolidones, etc., for the purpose of increasing sensitivity, increasing contrast, and accelerating development. Specific examples of these compounds are described, for example, in U.S. Pat. Nos. 2,400,532, 2,423,549, 2,716,062, 3,617,280, 3,772,021, 3,808,003; British Pat. No. 1,488,991, etc.

Also, the color photographic materials of this invention may further contain, in the silver halide photographic emulsion layers or other hydrophilic colloid layer, water-insoluble or water-sparingly soluble synthetic polymer dispersion for the purpose of improving the dimensional stability.

The silver halide photographic materials of this invention can contain various color couplers. A color coupler means a compound capable of forming a dye by causing a reaction with the oxidation product of an aromatic primary aminine developing agent. Typical examples of useful color couplers include naphthol compounds, phenol compounds, pyrazolone compounds, pyrazoloazole compounds, and open chain or heterocyclic ketomethylene compounds.

Specific examples of the cyan, magenta, and yellow couplers for use in this invention are described, for example, in *Research Disclosure,* RD No. 17643 (December 1978), Paragraph VII-D, and ibid, RD No. 18717 (November 1979), etc.

It is preferred that these couplers for use in this invention have a ballast group or are polymerized to become non-diffusible.

Furthermore, it is preferred that hydrogen present in a coupling position of the color coupler for use in this invention is substituted by a releasable group. In this invention, couplers proper in diffusible property of colored dye, colored couplers, non-coloring couplers, couplers releasing development inhibitors or development accelerators with the occurrence of coupling reaction, etc., can all be used.

Specific examples of the yellow couplers for use in this invention are oil-protect type acylacetamido couplers. Typical examples of these couplers are described in U.S. Pat. Nos. 2,407,210, 2,875,057, 3,265,506, etc.

In this invention, two-equivalent yellow couplers are preferably used, and specific examples of such yellow couplers are the oxygen atom-releasing type yellow couplers described in U.S. Pat. Nos. 3,408,194, 3,447,928, 3,933,501, 4,401,752, etc.; and then nitrogen atom-releasing type yellow couplers described in Japanese Patent Publication No. 10739/83; U.S. Pat. Nos. 4,022,620, 4,326,024; *Research Disclosure,* RD No. 18053 (April 1979); British Pat. No. 1,425,020; West German Patent Application (OLS) Nos. 2,219,917, 2,261,361, 2,329,587, 2,433,812, etc. Moreover, α-pivaloyl acetanilide series couplers have the desirable feature of the fastness of colored dyes, and on the other hand, α-benzoylacetanilide series couplers have the features in good coloring property.

Examples of the magenta couplers for use in this invention, there are oil-protect type indazolone series or cyanoacetyl series pyrazolone couplers, or preferably, 5-pyrazolone series and pyrazoltriazole couplers. As the 5-pyrazolone series couplers, the couplers the 3-position of which is substituted by an arylamino group or an acylamino group are preferred from the viewpoints of the hue and the coloring speed of the colored dyes. Specific examples of these couplers are described in U.S. Pat. Nos. 2,311,082, 2,343,703, 2,600,788, 2,908,573, 3,062,653, 3,152,896, and 3,936,015. Preferred examples of the two-equivalent 5-pyrazolone type couplers have, preferably, a nitrogen atom-releasing group as described in U.S. Pat. No. 4,310,619 or an arylthio group as described in U.S. Pat. No. 4,351,897 as the releasing group. Also, the 5-pyrazolone type couplers having a ballast group described in European Pat. No. 73,636 have a high coloring reactivity.

Pyrazoloazole type couplers include pyrazolobenzimidazole couplers described in U.S. Pat. No. 3,369,897, preferably the pyrazolo[5,1-c][1,2,4]triazoles described in U.S. Pat. No. 3,725,067; the pyrazolotetrazoles described in *Research Disclosures,* RD No. 24220 (June 1984); and the pyrazolopyrazoles described in *Research Disclosure,* RD No. 24230 (June 1984). The imidazopyrazoles described in Japanese Patent Application No. 23434/83 and the pyrazolo[1,5-b][1,2,4]triazoles described in Japanese Patent Application No. 45512/83 are most preferred in having less yellow side absorption of the colored dyes and good light-fastness of the dyes.

As the cyan couplers for use in this invention, oil-protect type naphthol or phenol type couplers can be used, and specific examples of these cyan couplers include naphthol type couplers as described in U.S. Pat. No. 2,474,293, preferably the oxygen atom-releasing type highly-active two equivalent naphthol type couplers described in U.S. Pat. Nos. 4,052,212, 4,146,396, 4,228,233, and 4,296,200. Practical examples of the phenol type couplers are described in U.S. Pat. Nos. 2,369,929, 2,423,730, 2,772,162 and 2,895,826.

Cyan couplers having fastness to heat, humidity, and temperature are preferably used in this invention and typical examples of these couplers are the phenol type cyan couplers described in U.S. Pat. No. 3,772,002; the 2,5-diacylamino-substituted phenol type couplers described in U.S. Pat. Nos. 2,772,162, 3,758,308, 4,126,396, 4,334,011 and 4,327,173; West German Patent Application (OLS) No. 3,329,729; and Japanese Patent Application No. 42671/83 and the phenol type couplers having a phenylureido group at the 2-position and an acylamino group at the 5-position as described in U.S. Pat. Nos. 3,446,622, 4,333,999, 4,451,559 and 4,427,767.

These color couplers may form polymers of dimers or more (inclusive of dimers). Typical examples of the polymer couplers are described in U.S. Pat. Nos. 3,451,820 and 4,080,211. Also, practical examples of the polymer magenta couplers are described in British Pat. No. 2,102,173 and U.S. Pat. No. 4,367,282.

Also, in this invention, the graininess of the photographic materials of this invention can be improved by using colored dye-diffusing type couplers together with the aforesaid color couplers. In regard to these couplers, specific examples of the magenta couplers are described in U.S. Pat. No. 4,366,237 and British Pat. No. 2,125,570 and specific examples of the yellow, magenta, and cyan couplers are described in European Pat. No. 96,873 and West German Patent Application (OLS) No. 3,324,533.

The coupler for use in this invention can be introduced into the photographic material in various manners, such as a solid dispersion method, an alkali dispersion method, or preferably a latex dispersion method, and more preferably an oil-in-water dispersion method.

In the oil-in-water dispersion method, the coupler is dissolved in a high boiling organic solvent having a boiling point of higher than 175° C., a low boiling auxiliary solvent or a mixture thereof, and then finely dispersed as the solution thereof in water or an aqueous solution of a water-soluble binder such as gelatin in the presence of a surface active agent. Examples of the high boiling organic solvent are described in U.S. Pat. No. 2,322,027, etc. The dispersion may be performed by a phase inversion, and, if necessary, after reducing the content of the auxiliary solvent by evaporation, noodle washing, or ultrafiltration, the dispersion may be coated.

Specific examples of the high-boiling organic solvent are phthalic acid esters (e.g., dibutyl phthalate, dicyclohexyl phthalate, di-2-ethylhexyl phthalate, didodecyl phthalate, etc.), phosphoric acid or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate, etc.), benzoic acid esters (e.g., 2-ethylhexyl benzoate, dodecyl benzoate, 2-ethylhexyl-p-hydroxybenzoate, etc.), amides (e.g., diethyldodecaneamide, N-tetradecylpyrrolidone, etc.), alcohols or phenols (e.g., isostearyl alcohol, 2,4-di-tert-amylphenol, etc.), aliphatic carboxylic acid esters (e.g., dioctyl azerate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc.

Also, as the auxiliary solvents, organic solvents having a boiling point of from about 30° C. to about 160° C. can be used. Specific examples of auxiliary solvents are ethyl acetate, butyl acetate, ethyl propionate, methyl ethyl ketone, cyclohexanone, 2-ethoxyethyl acetate, dimethylformamide, etc.

Specific examples of the latex dispersion method, the effects thereof, and the latexes for impregnation are described in U.S. Pat. No. 4,199,363, etc.

For the photographic materials of this invention, known fading preventing agents can be used. Such fading preventing agents include hydroquinones, 6-hydroxychromanes, 5-hydroxycoumaranes, spirochromanes, spiroindanes, p-alkoxyphenols, hindered phenols such as bisphenols, gallic acid derivatives, methylenedioxybenzenes, aminophenols, hindered amines, the ether or ester derivatives of these compounds formed by silylating, acylating, or alkylating the phenolic hydroxy groups of the compounds, and metal complexes.

Specific examples of such compounds are described in the following publications.

That is, hydroquinones are described in U.S. Pat. Nos. 2,360,290, 2,418,613, 2,700,453, 2,701,197, 2,728,659, 2,732,300, 2,735,765, 3,982,944 and 4,430,425; British Pat. No. 1,363,921; U.S. Pat. Nos. 2,710,801, 2,816,028, etc.; 6-hydroxychromanes, 5-hydroxycoumaranes, and spirochromanes are described in U.S. Pat. Nos. 3,432,300, 3,573,050, 3,574,627, 3,698,909, and 3,764,337; Japanese Patent Application (OPI) No. 152225/77, etc.; spiroindanes are described in U.S. Pat. No. 4,360,589; p-alkoxyphenols are described in U.S. Pat. No. 2,735,765; British Pat. No. 2,066,975(B); Japanese Patent Application (OPI) No. 10539/84; Japanese Patent Publication No. 19764/82, etc.; hindered phenols are described in U.S. Pat. No. 3,700,455; Japanese Patent Application (OPI) No. 72225/77; U.S. Pat. No. 4,228,235; Japanese Patent Publication No. 6623/77, etc.; gallic acid derivatives, methylenedioxybenzenes, and aminophenol derivatives are described in U.S. Pat. Nos. 3,457,079 and 4,332,886; Japanese Patent Publication No. 21144/81, etc., respectively; hindered amines are described in U.S. Pat. Nos. 3,336,135 and 4,268,593; British Pat. No. 1,326,889, 1,354,313 and 1,410,846; Japanese Patent Publication No. 1420/76; Japanese Patent Application (OPI) Nos. 114036/83, 53846/84, 78344/84, etc.; ether and ester derivatives of phenolic hydroxy groups are described in U.S. Pat. Nos. 4,155,765, 4,174,220, 4,254,216 and 4,264,720; Japanese Patent Application (OPI) Nos. 145530/79, 6321/80, 105147/83 and 10539/84; Japanese Patent Publication No. 37856/82, U.S. Pat. No. 4,279,990, Japanese Patent Publication No. 3263/78, etc.; and metal complexes are described in U.S. Pat. Nos. 4,050,938, 4,241,155; British Pat. No. 2,027,731(A), etc.

The color photographic materials of this invention may further contain hydroquinone derivatives, aminophenol derivatives, gallic acid derivatives, ascorbic acid derivatives, etc., as a color fog preventing agent. Specific examples of these compounds are described in U.S. Pat. Nos. 2,360,290, 2,336,327, 2,403,721, 2,418,613, 2,675,314, 2,701,197, 2,704,713, 2,728,659, 2,732,300 and 2,735,765; Japanese Patent Application (OPI) Nos. 92988/75, 92989/75, 93928/75, 110337/75 and 146235/77; Japanese Patent Publication No. 23813/75, etc.

The color photographic materials of this invention may further contain ultraviolet absorbents in the hydrophilic colloid layers thereof. Examples of the ultraviolet absorbents are benzotriazole compounds substituted by an aryl group (described, for example, in U.S. Pat. No. 3,533,794, etc.), 4-thiazolidone compounds (described, for example, in U.S. Pat. Nos. 3,314,794, 3,352,681, etc.), benzophenone compounds (described, for example, in Japanese Patent Application (OPI) No. 2784/71, etc.), cinnamic acid ester compounds (described, for example, in U.S. Pat. Nos. 3,705,805, 3,707,375, etc.), butadiene compounds (described, for example, in U.S. Pat. No. 4,045,229, etc.), and benzoxydol compounds (described, for example, in U.S. Pat. No. 3,700,455, etc.). Furthermore, the compounds described in U.S. Pat. No. 3,499,762 and Japanese Patent Application (OPI) No. 48535/79 can be used. Also, ultraviolet absorptive couplers (e.g., α-naphtholic cyan dye-forming couplers) and ultraviolet absorptive polymers may be used. These ultraviolet absorbents may be mordanted to specific layers of the photographic materials of this invention.

The color photographic materials of this invention may further contain water-soluble dyes as filter dyes or for various purposes of irradiation prevention or etc. in hydrophilic colloid layers. Such dyes include oxonol dyes, hemioxonol dyes, styryl dyes, merocyanine dyes, cyanine dyes, and azo dyes. In these dyes, oxonol dyes, hemioxonol dyes, and merocyanine dyes are particularly useful. Specific examples of these dyes are described in British Pat. Nos. 584,609 and 1,177,429; Japanese Patent Application (OPI) Nos. 85130/73, 99620/74, 114420/74 and 108115/77; U.S. Pat. Nos. 2,274,782, 2,533,472, 2,956,879, 3,148,187, 3,177,078, 3,247,127, 3,540,887, 3,575,704, 3,653,905, 3,718,472, 4,071,312, 4,070,352, etc.

When the photographic materials of this invention contain dyes or ultraviolet absorbents in the hydrophilic colloid layers, these compounds may be mordanted by a cationic polymer. Such cationic polymers which are used for such purpose are described, for example, in U.S. Pat. Nos. 2,685,475, 2,675,316, 2,839,401, 2,882,156, 3,048,487, 3,184,309 and 3,445,231; West German Patent Application (OLS) No. 1,914,362; Japanese Patent Application (OPI) Nos. 47624/75, 71332/75, etc.

For photographic processing the color photographic materials of this invention, the color image forming processes described in *Research Disclosure,* No. 176, pages 28–30 can be used. It is preferred that the processing temperature is between 18° C. to 60° C., but the photographic materials of this invention have an aptitude for high-temperature quick processing at temperatures higher than 30° C.

The processing steps for forming color negative images are fundamentally composed of (1) color development→(2) bleach→(3) fix→(4) wash→(5) drying and the processing steps for forming color reversal images are fundamentally composed of (1) first development (black-and-white development)→(2) reversal→(3) color development→(4) bleach→(5) fix→(6) wash→(7) drying.

In the above-described processes, it is preferred to shorten the processing time by performing the bleach and fix in a mono-bath (blix bath).

The reversal process in the steps of forming color reversal images may be performed by processing the color photographic materials of this invention by a fogging bath but the use of reversal exposure is preferred from the points of processing time and the cost. Also, for the above-described photographic processing, steps, auxiliary processing steps such as a pre-hardening step, control step, stabilization step, etc., may be additionally employed.

For the first developer which is used for the color reversal image-formation, a developing agent can be used. Examples of such a developing agent are dihydroxybenzenes (e.g., hydroquinone, etc.), 3-pyrazolidones (e.g., 1-phenyl-3-pyrazolidone, etc.), aminophenols (e.g., N-methyl-p-aminophenol, etc.), 1-phenyl-3-pyrazolines, ascorbic acid, the heterocyclic compounds formed by the condensation of 1,2,3,4-tetrahydroquinoline ring and an indolenine ring as described in U.S. Pat. No. 4,067,872. They can be used inidividually or as a combination thereof.

The first developer which is used for the color reversal image formation can further contain a preservative (e.g., sulfites, hydrogensulfites, etc.), a buffer (e.g., carbonates, boric acid, borates, alkanolamine, etc.), an alkali agent (e.g., hydroxides, carbonates, etc.), a dissolution aid (e.g., polyethylene glycols, esters thereof, etc., a pH controlling agent (e.g., organic acids such as acetic acid, etc.), a sensitizer (e.g., quaternary ammonium salts, etc.), a development accelerator, a surface active agent, a color toning agent, a defoaming agent, a hardening agent, a tackifier, etc.

Furthermore, the first developer may contain an antifoggant (e.g., halides such as potassium bromide, sodium bromide, etc.; benzimidazoles, benzotriazoles, benzthiazoles, tetrazoles, thiazoles, etc.), or a chelating agent (e.g., ethylenediaminetetraacetic acid, the alkali metal salts of the acid, polyphosphates, nitroacetates, etc.).

The pH value of the developer is selected as necessary to provide a desired density and contrast, but is preferably in a range of from about 8.5 to about 11.5.

In the case of using a fogging bath for the reversal step in the color reversal image formation, the bath may contain various kinds of known fogging agents. Examples of the fogging agents are boron compounds such as the boron hydride compounds of stannous ion complex salts (U.S. Pat. No. 2,984,567), e.g., stannous ion-organic phosphoric acid complex salts (described in U.S. Pat. No. 3,617,282), stannous ion-organic phosphonocarboxylic acid complex salts (described in Japanese Patent Publication No. 32616/81), stannous ion-aminopolycarboxylic acid complex salts (described in British Pat. No. 1,209,050), etc.; heterocyclic amine borone compounds (described in British Pat. No. 1,011,000), etc. The pH of the fogging agent (reversal bath) can vary over a wide range of from an acid side or an alkaline side. That is, the pH selected in a range of from 2 to 12, preferably from 2.5 to 10, and particularly preferably from 3 to 9.

The color developer which is used for developing the color photographic materials of this invention contains an aromatic primary amine developing agent. Preferred examples of the aromatic primary amine color developing agent are p-phenylenediamine derivatives, such as N,N-diethyl-p-phenylenediamine, 2-amino-5-diethylaminotoluene, 2-amino-5-(N-ethyl-N-laurylamino)-toluene, 4-[N-ethyl-N-(β-hyroxyethyl)amino]aniline, 2-methyl-4-[N-ethyl-N-(β-hydroxyethyl)amino]aniline, N-ethyl-N-(β-methanesulfoamidoethyl)-3-methyl-4-aminoaniline, N-(2-amino-5-diethylaminophenylethyl)-methanesulfonamide, N,N-dimethyl-p-phenylenediamine, as well as 4-amino-3-methyl-N-ethyl-N-methoxyethylaniline, 4-amino-3-methyl-N-ethyl-N-β-ethoxyethylaniline, and 4-amino-3-methyl-N-ethyl-N-β-butoxyethylaniline and the salts thereof (e.g., sulfates, hydrochlorides, sulfites, p-toluenesulfonates, etc.) described in U.S. Pat. Nos. 3,656,950, 3,698,525, etc.

The color developers may further contain other components for developer, such as alkali agents, buffers, etc., such as sodium hydroxide, potassium hydroxide, sodium carbonate, potassium carbonate, sodium or potassium tertiary phosphate, potassium metaborate, borax, etc., solely or as a combination thereof.

The color developer may further contain a preservative, such as a sulfite (e.g., sodium sulfite, potassium sulfite, potassium hydrogensulfite, sodium hydrogensulfite, etc.) and hydroxylamine.

If desired, the color developer may further contain a development accelerator. Examples of development accelerators include the various pyridinium compounds and other cationic compounds described, for example, in U.S. Pat. No. 2,648,604; Japanese Patent Publication No. 9503/69; and U.S. Pat. No. 3,671,247; cationic dyes such as phenosafranine; neutral salts such as thallium nitrate and potassium nitrate; polyethylene glycol and the derivatives thereof as described in Japanese Patent Publication No. 9504/69; U.S. Pat. Nos. 2,533,990, 2,531,832, 2,850,970, 2,577,127, etc.; nonionic compounds such as polythioethers, the organic solvents and organic amines as described in Japanese Patent Publication No. 9509/69 and Belgian Pat. No. 682,862; ethanolamine, ethylenediamine, diethanolamine, etc., and also the accelerators described in L. F. A. Mason, *Photographic Processing Chemistry,* pages 40 to 43, published by The Focal Press, London (1966).

Furthermore, the color developer may further contain aminopolycarboxylic acids such as ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, etc., as a water softener.

Moreover, the color developer may further contain a completing coupler or an auxiliary developing agent.

Examples of the useful competing coupler are citrazinic acid, J-acid, H-acid, etc.

Examples of the auxiliary developing agent are p-aminophenol, N-benzyl-p-aminophenol, 1-phenyl-3-pyrazolidone, etc.

The pH of the color developer is preferably in a range of from about 8 to 13. The temperature of the color developer is usually selected in a range of from 20° C. to 70° C., but is preferably from 30° C. to 60° C.

The color photographic materials of this invention are usually bleached after color development. The bleaching process may be performed simultaneously with a fix process or may be performed separately from a fix process. Examples of the bleaching agent are compounds of a multivalent metal such as iron (III), cobalt (IV), chromium (VI), copper (II), etc., peracids, quinones, nitroso compounds, etc. For example, there are ferrycianides, dichromates, organic complex salts of iron (III) or cobalt (III), aminopolycarboxylic acids (e.g., ethylenediaminetetraacetic acid, nitrilotriacetic acid, 1,3-diamino-2-propanoltetraacetic acid, etc., complex salts of an organic acid (e.g., citric acid, tartaric acid, malic acid, etc.), persulfates, permanganates, nitrosophenol, etc. In these compounds, potassium ferricyanide, ethylenediaminetetraacetic acid iron (III) sodium and ethylenediaminetetraacetic acid iron (III) ammonium are particularly advantageous. The aminopolycarboxylic acid iron (III) complex salt is advantageous for both the bleach solution and the blix solution.

The bleach solution or the blix solution may further contain the bleach accelerators as described in U.S. Pat. Nos. 3,042,520 and 3,241,966; Japanese Patent Publication Nos. 8506/70, 8836/70; etc. The bleach or blix solution may further contain various other additives.

Then, the present invention will be explained in detail with the reference to the following examples but the invention should not be construed as being limited to these examples.

EXAMPLE 1

A color photographic material was prepared by coating, in succession, following layer 1 to layer 11 on a paper support both surfaces of which are laminated with polyethylene.

Support: Polyethylene-laminated paper [containing white pigment(s) ($TiO_2$, etc.) and bluish dye(s) (ultramarine, etc.)] in the polyethylene layer at the emulsion layer side.

Layer 1 (Antihalation Layer)

A layer containing 100 mg/m$^2$ of black colloidal silver and 2,000 mg/m$^2$ of gelatin.

Layer 2 (Low-Speed Red-Sensitive Emulsion Layer)

A layer containing 150 mg/m$^2$ (calculated as silver) of a mono-dispersed silver iodobromide emulsion (3.5 mole% silver iodide, 0.35 micron in mean grain size), which was prepared by conducting the grain formation in the presence of silver halide solvent I-12 and spectrally sensitized by red-sensitizing dyes (*15 and *16), 1,000 mg/m$^2$ of gelatin, 300 mg/m$^2$ of a cyan coupler (*17), 150 mg/m$^2$ of a fading preventing agent (*18), and 60 mg/m$^2$ of coupler solvents (*5 and *19).

Layer 3 (High-Speed Red-Sensitive Emulsion Layer)

A layer containing 100 mg/m$^2$ (calculated as silver) of a silver iodobromide emulsion (8.0 mole% silver iodide, 0.7 micron in mean grain size) spectrally sensitized by red-sensitizing dyes (*15 and *16), 500 mg/m$^2$ of gelatin, 100 mg/m$^2$ of cyan coupler (*17), 50 mg/m$^2$ of a fading preventing agent (*18), and 20 mg/m$^2$ of coupler solvents (*5 and *19).

Layer 4 (Interlayer)

A layer containing 20 mg/m$^2$ of yellow colloid silver, 1,000 mg/m$^2$ of gelatin, 80 mg/m$^2$ of a fading preventing agent (*6), 160 mg/m$^2$ of a fading preventing agent solvent (*7), and 400 mg/m$^2$ of a polymer latex (*14).

Layer 5 (Low-Speed Green-Sensitive Emulsion Layer)

A layer containing 200 mg/m$^2$ (calculated as silver) of a mono-dispersed silver iodobromide emulsion (2.5 mole% silver iodide, 0.4 micron in mean grain size), which was prepared by performing the grain formation in the presence of silver halide solvent I-12 and spectrally sensitized by green-sensitizing dye (*8), 700 mg/m$^2$ of gelatin, 150 mg/m$^2$ of a magenta coupler (*9), 50 mg/m$^2$ of fading preventing agent A (*10), 50 mg/m$^2$ of fading preventing agent B (*11), 20 mg/m$^2$ of fading preventing agent C (*12), and 150 mg/m$^2$ of a coupler solvent (*13).

Layer 6 (High-Speed Green-Sensitive Emulsion Layer)

A layer containing 200 mg/m$^2$ (calculated as silver) of a silver iodobromide emulsion (3.5 mole% silver iodide, 0.9 micron in mean grain size) spectrally sensitized by a green-sensitizing dye (*8), 700 mg/m$^2$ of gelatin, 150 mg/m$^2$ of a magenta coupler (*9), 50 mg/m$^2$ of fading preventing agent A (*10), 50 mg/m$^2$ of fading preventing agent B (*11), 20 mg/m$^2$ of fading preventing agent C (*12), and 150 mg/m$^2$ of a coupler solvent (*2).

Layer 7 (Yellow Filter Layer)

A layer containing 200 mg/m$^2$ of yellow colloidal silver, 1,000 mg/m$^2$ of gelatin, 60 mg/m$^2$ of a fading preventing agent (*6), and 240 mg/m$^2$ of a fading preventing agent solvent (*7).

Layer 8 (Low-Speed Blue-Sensitive Emulsion Layer)

A layer containing 150 mg/m$^2$ (calculated as silver) of a mono-dispersed silver iodobromide emulsion (2.5 mole% silver iodide, 0.5 micron in mean grain size), which was prepared by conducting the grain formation in the presence of silver halide solvent I-12 and spectrally sensitized by a blue-sensitizing dye (*4), 500 mg/m$^2$ of gelatin, 200 mg/m$^2$ of a yellow coupler (*5), and 50 mg/m$^2$ of a coupler solvent (*2).

Layer 9 (High-Speed Blue-Sensitive Emulsion Layer)

A layer containing 200 mg/m$^2$ (calculated as silver) of a silver iodobromide emulsion (2.5 mole% silver iodide, 1.0 micron in mean grain size) spectrally sensitized by a blue-sensitizing dye (*4), 1,000 mg/m$^2$ of gelatin, 400 mg/m$^2$ of a yellow coupler (*5), and 100 mg/m$^2$ of a coupler solvent (*2).

Layer 10 (Ultraviolet Absorption Layer)

A layer containing 1,500 mg/m$^2$ of gelatin, 1,000 mg/m$^2$ of a ultraviolet absorbent (*1), 300 mg/m$^2$ of a ultraviolet absorbent solvent (*2), and 80 mg/m$^2$ of a color mixing preventing agent (*3).

Layer 11 (Protective Layer)

A layer containing 1,000 mg/m$^2$ of gelatin.

The compounds used in the case of preparing the color photographic materials as described were as follows:

*1: 5-Chloro-2-(2-hydroxy-3-t-butyl-5-t-octyl)phenylbenztriazole

*2: Phosphoric acid trinonyl ester

*3: 2,4-Di-sec-octylhydroquinone

*4: Triethylammonium 3-[2-(3-benzylrhodanine-5-indene)-3-benzoxazolinyl]propanesulfonate

*5: α-Pivaloyl-α-[(2,4-dioxo-1-benzyl-5-ethoxyhydantoin-3-yl)-2-chloro-5-(α-2,4-di-t-amylphenoxy)-butanamido]acetanilide

*6: 2,4-Di-t-octylhydroquinone

*7: Phosphoric acid o-cresyl ester

*8: 5,5'-Diphenyl-9-ethyl-3,3'-disulfopropyloxacarbocyanine sodium salt

*9: 1-(2,4,6-Trichlorophenyl)-3-(2-chloro-5-tetradecanamido)anilino-2-pyrazolino-5-one

*10: 3,3,3',3'-Tetramethyl-5,6,5',6'-tetrapropoxy-1,1'-bisspiroindane

*11: Di-(2-hydroxy-3-t-butyl-5-methylphenyl)methane

*12: 2,4-Di-t-hexylhydroquinone

*13: Phosphoric acid trioctyl ester

*14: Polyethyl acrylate

*15: Triethylammonium 3-[2-{2-[3-(3-sulfopropyl)naphtho(1,2-d)thiazolin-2-iridenmethyl]-1-butenyl}-2-naphth(1,2-d)thiazolino]propanesulfonate

*16: 5,5'-Dichloro-3,3'-di-(3-sulfobutyl)-9-ethylthiacarbonylcyanine sodium salt

*17: 2-[α-(2,4-Di-t-amylphenoxy)butanamido]-4,6-dichloro-5-methylphenol

*18: 2-(2-Hydroxy-3-sec-butyl-5-t-butylphenyl)benzotriazole

*19: Dioctyl phthalate

The photographic material prepared as above was a comparison sample and defined as Sample No. 101.

Then, a silver halide emulsion having substantially light-insensitivity for use in this invention was prepared by the following manner.

Solution I:

Solution containing water in an amount as shown in the following table and 18 g of gelatin, and having a pH value of 3.0.

Solution II:

Solution containing 200 g of $AgNO_3$ and 800 ml of water.

Solution III:

Solution containing 800 ml of water, and KBr, NaCl and $NH_4RhCl_4$ each in an amount as shown in the following table.

The above-described Solutions II and III were simultaneously introduced into the above-described Solution I in the predetermined addition rate while each solution kept at temperature as described in the following table. After from the thus prepared emulsion was removed water soluble salts by the conventional method, to the resulted emulsion was added gelatin. The emulsion was produced in a yield of 1 kg, which contained 60 g of gelatin.

| Emulsion | Solution I Water | Solution II KBr | Solution II NaCl | Solution II $NH_4RhCl_6$ | Temperature of Solution I, II or III | Halogen Composition | Mean Grain Size | Rhodium Content |
|---|---|---|---|---|---|---|---|---|
| (A) | 1400 ml | 148 g | — | — | 40° C. | AgBr | 0.035 μm | — |
| (B) | 600 ml | " | — | — | 50° C. | AgBr | 0.18 μm | — |
| (C) | 1400 ml | 2.8 g | 71 g | — | 40° C. | AgBrCl (Br/Cl = 2/98) | 0.07 μm | — |
| (D) | 1000 ml | " | " | — | 50° C. | (Br/Cl = 2/98) | 0.11 μm | — |
| (E) | 600 ml | " | " | — | 68° C. | (Br/Cl = 2/98) | 0.37 μm | — |
| (F) | " | " | " | 40 mg | 50° C. | (Br/Cl = 2/98) | 0.23 μm | $10^{-4}$ mole/mole-silver |
| (G) | 1400 ml | — | 73 g | — | 40° C. | AgCl | 0.16 μm | — |
| (H) | 600 ml | 17.8 g | 64 g | — | 40° C. | AgBrAl (Br/Cl = 12/88) | 0.14 μm | — |
| (I) | " | 35.5 g | 56 g | — | " | AgBrCl (Br/Cl = 24/76) | 0.10 μm | — |
| (J) | " | 107 g | 21 g | — | " | AgBrCl (Br/Cl = 72/28) | 0.08 μm | — |

By following the same procedure as in the case of preparing Sample No. 101 except that each of Emulsions (A) to (J) thus prepared was added to Layer 11 (protective layer) at the silver coverage shown in Table 1, Samples 102 to 111 were prepared.

Each of the samples was exposed through a sensitometeric wedge to white light of a light source of 4800° K. under an exposed surface illuminance of 1,000 lux, and then subjected to the standard reversal processing process shown below to provide color images.

Processing steps used were as follows.

| Processing Step: | | |
|---|---|---|
| First Development (White-and-Black Development) | 38° C. | 75 sec. |
| Wash | 38° C. | 90 sec. |
| Reversal Exposure | 100 lux | |
| Color Development | 38° C. | 135 sec. |
| Wash | 38° C. | 45 sec. |
| Bleach | 38° C. | 120 sec. |
| Wash | 38° C. | 135 sec. |
| Drying | | |

The compositions of the processing solutions used for the above processing steps were as follows.

| First Developer: | |
|---|---|
| Nitrilo-N,N,N—trimethylenephosphonic acid 6-sodium salt | 3.0 g |
| Anhydrous potassium sulfide | 20.0 g |
| Sodium thiocyanate | 1.2 g |
| 1-Phenyl-4-methyl-4-hydroxymethyl-3-pyrazolidone | 2.0 g |
| Anhydrous sodium carbonate | 3.0 g |
| Hydroquinone monosulfonate potassium salt | 30.0 g |
| Potassium bromide | 2.5 g |
| Potassium iodide (0.1% aq. soln.) | 2 ml |
| Water to make | 1000 ml |

-continued

| | |
|---|---|
| pH adjusted to | 9.7 |
| Color Developer: | |
| Benzyl alcohol | 15.0 ml |
| Ethylene glycol | 12.0 ml |
| Nitrilo-N,N,N—trimethylenephosphonic acid 6-sodium salt | 3.0 g |
| Potassium carbonate | 26.0 g |
| Sodium sulfite | 2.0 g |
| 1,2-Di(2'-hydroxyethyl)mercaptoethane | 0.6 g |
| Hydroxylamine sulfate | 3.0 g |
| 3-Methyl-4-amino-N—ethyl-N—β-methane-sulfonamidoethylanine sulfate | 5.0 g |
| Sodium bromide | 0.5 g |
| Potassium iodide (0.1% aq. soln.) | 0.5 ml |
| Water to make | 1000 ml |
| pH adjusted to | 10.5 |
| Bleach Solution: | |
| Ethylenediamine-N,N,N',N'—tetraacetic acid iron (III) ammonium (2-hydrate) | 80 g |
| Sodium metahydrogensulfite | 15.0 g |
| Ammonium thiosulfate (58% aq. soln.) | 126.6 ml |
| 2-Mercapto-1,3,5-triazole | 0.20 g |
| Water to make | 1000 ml |
| pH adjusted to | 6.5 |

In the case of the reversal development process as shown in the above example, the effect of this invention is to reduce the influences of stirring of processing solution for the first development (black-and-white development). Therefore, the experiment was performed in one case with stirring (stirring by bubbling of nitrogen gas) of the developer during the first development (black-and-white development) and in another case not stirring the developer, and the difference in the performances obtained under the two conditions was evaluated.

For each sample thus processed, the spectral density of each color image was measured through a blue filter, a green filter, or a red filter and the effect of this invention was evaluated by the characteristic curve obtained. The density was measured by the reciprocal of the exposure amount necessary for obtaining a color image density of a definite density (D=0.50) on the characteristic curve. Also, gamma was measured by the difference of the point D=0.50 and a density point D' at which the exposure amount was larger than the log value (exposure amount) at D=0.50 by log (exposure amount)=1.00, and the gradation of the characteristic curve was evaluated by the gamma value.

For plainly showing the reliance on stirring of the developer at the first development (black-and-white development, the change of each sensitivity and the change of each gamma value between the case of stirring the developer and the case of not stirring the developer are shown in Table 1.

That is:

[Sensitivity change]=[Sensitivity at stirring]−[Sensitivity at no stirring]

[Gamma change]=[Gamma at stirring]−[Gamma at no stirring]

Since such a characteristic value existed about each characteristic value measured using a blue filter, a green filter or a red filter, all the characteristic values are shown in Table 1. It can be seen that if the values of the sensitivity charge and the gamma value change near zero or as close as possible thereto, the reliance to the stirring condition is less, the development finish obtained is almost optimum even when the stirring condition is changed, and images having stable and optimum performance are always obtained regardless of the sort of processors employed for the development process.

From the results shown in Table 1, it can be seen that the samples (Sample Nos. 104 to 110) of this invention each containing in the auxiliary layer silver halide grains having substantially light-insensitivity and containing more than 75% silver chloride, are much less influenced by the extent of stirring of the developer during the first development as compared with the comparison samples (Sample No. 101) containing no such silver halide grains. It can also be seen that in these samples of this invention, the sample (Sample No. 107) of this invention, wherein the silver halide grains having substantially light-insensitivity contain a rhodium salt, shows particularly excellent performance. Also, comparison samples (Sample Nos. 102, 103 and 111) containing in the auxiliary layer silver halide grains having substantially light-insensitivity, but having a different halogen composition from the halogen composition as defined for this invention, show performance only similar to that of the sample (Sample No. 101) containing no such silver halide grains.

TABLE 1

| | Layer 11: Composition of Protective Layer | | Photographic Characteristics | | | | | |
|---|---|---|---|---|---|---|---|---|
| | | | Sensitivity Change | | | Gamma Change | | |
| Sample No. | Kind of Light-Insensitive Silver Halide | Coated Amount* | B (Blue Filter) | G (Green Filter) | R (Red Filter) | B (Blue Filter) | G (Green Filter) | R (Red Filter) |
| 101 | — | — | 0.18 | 0.33 | 0.29 | 0.13 | 0.20 | 0.19 |
| 102 | (A) | $1.9 \times 10^{-2}$ | 0.14 | 0.23 | 0.20 | 0.09 | 0.16 | 0.14 |
| 103 | (B) | " | 0.16 | 0.30 | 0.29 | 0.11 | 0.18 | 0.20 |
| 104 | (C) | " | 0.13 | 0.14 | 0.09 | 0.03 | 0.10 | 0.07 |
| 105 | (D) | " | 0.04 | 0.09 | 0.04 | 0.02 | 0.09 | 0.05 |
| 106 | (E) | " | 0.07 | 0.09 | 0.04 | 0.04 | 0.07 | 0.03 |
| 107 | (F) | " | 0.02 | 0.05 | 0.02 | 0 | 0.04 | 0 |
| 108 | (G) | " | 0.08 | 0.11 | 0.05 | 0.04 | 0.07 | 0.04 |
| 109 | (H) | " | 0.09 | 0.09 | 0.05 | 0.05 | 0.04 | 0.05 |
| 110 | (I) | " | 0.13 | 0.15 | 0.10 | 0.06 | 0.10 | 0.07 |
| 111 | (J) | " | 0.15 | 0.23 | 0.19 | 0.09 | 0.15 | 0.12 |

*Coated amount of the light-insensitive silver halide ($g/m^2$ in silver coverage)

EXAMPLE 2

In the layers constituting the photographic materials shown in Example 1, the magenta coupler (*9) contained in Layer 5 and Layer 6 was replaced with an equimolar mixture of magenta couplers (*20 and *21) shown below, the fading preventing agent C (*12) was replaced with a fading preventing agent (*22), and the coupler solvent (*13) was replaced with a coupler solvent (*23). Also, the cyan coupler (*17) contained in Layer 2 and Layer 3 was replaced with an equimolar mixture of cyan couplers (*24 and *25) shown below.

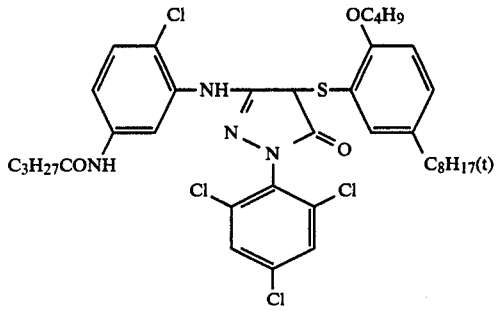

*20

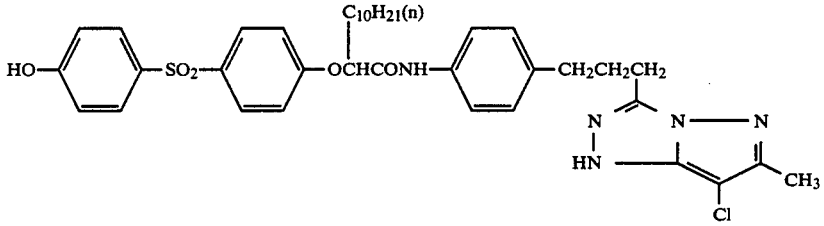

*21

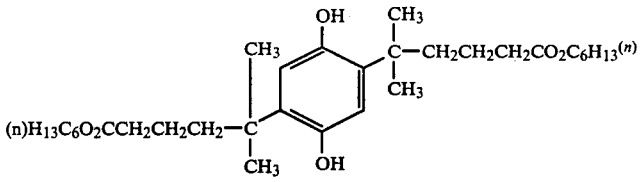

*22

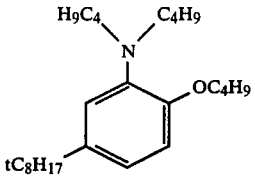

*23

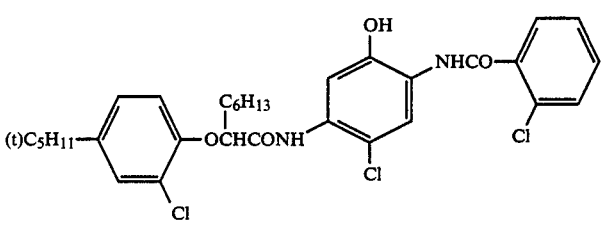

*24

*25: 2-[α-(2,4-Di-t-amylphenoxy)butanamido]-4,6-dichloro-5-ethylphenol

Thus, a comparison sample, Sample No. 201 was prepared by the following the same procedure as Sample No. 101, except that Layers 2, 3, 5 and 6 were changed as described above. In these cases, the silver halide emulsions having substantially light-insensitivity were selected from those used in Example 1 and the coated amount of the silver halide emulsion was selected to became same as in Example 1.

The exposure, the development or processing, the density measurement, and the evaluation of performance about the samples thus obtained were performed under the same conditions as Example 1. The results thus obtained are shown in Table 2.

TABLE 2

| Sample No. | Layer 11: Composition of Protective Layer: Kind of Light-Insensitive Silver Halide | Layer 11: Composition of Protective Layer: Coated Amount* | Photographic Characteristics: Sensitivity Change: B (Blue Filter) | Sensitivity Change: G (Green Filter) | Sensitivity Change: R (Red Filter) | Gamma Change: B (Blue Filter) | Gamma Change: G (Green Filter) | Gamma Change: R (Red Filter) |
|---|---|---|---|---|---|---|---|---|
| 201 | — | — | 0.19 | 0.35 | 0.28 | 0.13 | 0.22 | 0.20 |
| 202 | (C) | $3.1 \times 10^{-2}$ | 0.09 | 0.11 | 0.08 | 0.03 | 0.09 | 0.06 |
| 203 | (E) | " | 0.05 | 0.08 | 0.05 | 0.03 | 0.06 | 0.04 |
| 204 | (F) | " | 0.03 | 0.04 | 0.02 | 0.01 | 0.03 | 0 |
| 205 | (G) | " | 0.07 | 0.10 | 0.06 | 0.04 | 0.06 | 0.03 |
| 206 | (I) | " | 0.10 | 0.12 | 0.08 | 0.04 | 0.08 | 0.05 |

*Coated amount of the light-insensitive silver halide (g/m$^2$ in silver coverage)

From the results shown in Table 2, it can be seen that the invention shows also excellent effect in the color photographic materials having different structures than those of the color photographic materials described in Example 1.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one red-sensitive silver halide emulsion layer, at least one green-sensitive silver halide emulsion layer, and at least one blue-sensitive silver halide emulsion layer, with at least one of said light-sensitive silver halide emulsion layers containing a mono-dispersed silver halide emulsion, said color photographic material further comprising at least one auxiliary layer containing silver halide grains having substantially light-insensitivity and containing more than 75 mole% silver chloride, wherein said auxiliary layer is formed on the outside of the light-sensitive silver halide emulsion layer disposed outermost of the light-sensitive silver halide emulsion layers with respect to the support thereof.

2. A silver halide color photographic material as in claim 1, wherein the mono-dispersed silver halide emulsion has a coefficient of variation of 0.20 or less.

3. A silver halide color photographic material as in claim 1, wherein the mono-dispersed silver halide emulsion has a coefficient of variation of 0.15 or less.

4. A silver halide color photographic material as in claim 1, wherein the mono-dispersed silver halide emulsion is used in an emulsion layer having lower sensitivity.

5. A silver halide color photographic material as in claim 1, wherein the light-sensitive silver halide is a negative type silver halide.

6. A silver halide color photographic material as in claim 1, wherein the silver halide grains having substantially light-insensitivity and containing at least 75 mole% silver chloride are prepared in the presence of a water-soluble rhodium salt present in an amount of more than $1\times10^{-6}$ mole per mole of silver at any time before finishing a first ripening.

7. A silver halide color photographic material as in claim 1, wherein the mono-dispersed light-sensitive silver halide emulsion is prepared in the presence of at least one tetra-substituted thiourea or organic thioether compound at any time before finishing a first ripening.

8. A silver halide color photographic material as in claim 1, wherein the silver halide grains having substantially light-insensitivity contain at least 90 mole% silver chloride.

9. A silver halide color photographic material as in claim 8, wherein said silver halide grains are prepared in the presence of water-soluble rhodium salt present in an amount of more than $1\times10^{-6}$ per mole of silver at any time before finishing a first ripening.

10. A silver halide color photographic material as in claim 6, wherein the rhodium salt is present in an amount of from $5\times10^{-5}$ to $1\times10^{-3}$ mole per mole of silver.

11. A silver halide color photographic material as in claim 1, wherein the silver halide grains having substantially light-insensitivity are present in the auxiliary layer in an amount of from $1\times10^{-6}$ mole/m$^2$ to $1\times10^{-2}$ mole/m$^2$, and the coating amount of silver in the auxiliary layer is from 0.2% by weight to 20% by weight.

12. A silver halide color photographic material as in claim 8, wherein the silver halide grains having substantially light-insensitivity are present in the auxiliary layer in an amount of from $1\times10^{-6}$ mole/m$^2$ to $1\times10^{-2}$ mole/m$^2$, and the coating amount of silver in the auxiliary layer is from 0.2% by weight to 20% by weight.

13. A silver halide color photographic material as in claim 5, wherein the light-sensitive silver halide is used for a color reversal photographic material.

* * * * *